US011608547B2

(12) United States Patent
Yang et al.

(10) Patent No.: US 11,608,547 B2
(45) Date of Patent: Mar. 21, 2023

(54) ENHANCED ALUMINUM ALLOY GALVANICALLY COMPATIBLE WITH MAGNESIUM ALLOY COMPONENTS

(71) Applicant: GM Global Technology Operations LLC, Detroit, MI (US)

(72) Inventors: Wenying Yang, Rochester Hills, MI (US); Qigui Wang, Rochester Hills, MI (US); Ming Liu, Pudong (CN)

(73) Assignee: GM Global Technology Operations LLC, Detroit, MI (US)

( * ) Notice: Subject to any disclaimer, the term of this patent is extended or adjusted under 35 U.S.C. 154(b) by 86 days.

(21) Appl. No.: 17/224,474

(22) Filed: Apr. 7, 2021

(65) Prior Publication Data

US 2022/0325385 A1 Oct. 13, 2022

(51) Int. Cl.
*C22C 21/02* (2006.01)

(52) U.S. Cl.
CPC ..... *C22C 21/02* (2013.01)

(58) Field of Classification Search
CPC ..... C22C 21/02; C22C 21/04; C22F 1/043
See application file for complete search history.

(56) References Cited

U.S. PATENT DOCUMENTS

2004/0011437 A1* 1/2004 Lin ..... C22C 21/04 148/702

* cited by examiner

*Primary Examiner* — Jessee R Roe
(74) *Attorney, Agent, or Firm* — Vivacqua Crane, PLLC

(57) ABSTRACT

An enhanced aluminum alloy galvanically compatible with a magnesium alloy component is disclosed. The aluminum alloy comprises aluminum, less than 0.2 weight percent copper, less than 0.2 weight percent iron, 6.0 to 9.0 weight percent silicon, 0.6 to 1.5 weight percent magnesium, and greater than 0.8 weight percent manganese. The aluminum alloy further comprises less than 2 weight percent zinc, less than 0.1 weight percent nickel, less than 0.2 weight percent tin, less than 0.05 weight percent titanium; and 0.008 to 0.02 weight percent strontium. Manganese and iron have a weight ratio of at least 30:1. Furthermore, iron and manganese combined content is less than 2.0 weight percent.

20 Claims, 3 Drawing Sheets

ENHANCED ALUMINUM ALLOY GALVANICALLY COMPATIBLE WITH MAGNESIUM ALLOY COMPONENTS

INTRODUCTION

The present disclosure relates to aluminum alloys and, more particularly, enhanced aluminum alloys galvanically compatible with magnesium alloy components.

Automotive components such as housings, cases, assemblies, and units include aluminum alloy components in direct contact with magnesium alloy components. At times, such contact results in galvanic corrosion. Improvements may be made in producing automotive components with galvanically compatible alloys.

SUMMARY

Thus, while current aluminum alloys achieve their intended purpose, there is a need for a new and improved aluminum alloy that is galvanically compatible with magnesium alloy components. According to several aspects of the present disclosure, an enhanced aluminum alloy galvanically compatible with a magnesium alloy component is provided.

In one aspect, the aluminum alloy comprises aluminum, less than 0.2 weight percent copper, less than 0.2 weight percent iron, 6.0 to 9.0 weight percent silicon, 0.6 to 1.5 weight percent magnesium, and greater than 0.8 weight percent manganese. The aluminum alloy further comprises less than 2 weight percent zinc, less than 0.1 weight percent nickel, less than 0.2 weight percent tin, less than 0.05 weight percent titanium, and 0.008 to 0.02 weight percent strontium. In this aspect, manganese and iron have a weight ratio of at least 30:1. Moreover, the combined iron and manganese content is less than 2.0 weight percent.

In an embodiment of this aspect, the aluminum alloy comprises less than 0.1 weight percent copper, less than 0.05 weight percent iron, 7.0 to 9.0 weight percent silicon, 0.8 to 1.2 weight percent magnesium, 0.8 to 1.5 weight percent manganese, and less than 1 weight percent zinc. The aluminum alloy further comprises less than 0.1 weight percent nickel, less than 0.2 weight percent tin, less than 0.05 weight percent titanium, and 0.008 to 0.015 weight percent strontium.

In another embodiment, the aluminum alloy comprises less than 0.05 weight percent copper, less than 0.03 weight percent iron, 7.5 to 8.5 weight percent silicon, 0.8 to 1.2 weight percent magnesium, 1.0 to 1.2 weight percent manganese, and less than 0.5 weight percent zinc. The aluminum alloy further comprises less than 0.1 weight percent nickel, less than 0.2 weight percent tin, less than 0.05 weight percent titanium, and 0.01 to 0.015 weight percent strontium.

In yet another embodiment of this aspect 3% or less of the aluminum alloy is liquid at the temperature range between 450 degrees Celsius and 550 degrees Celsius.

In still another embodiment, the aluminum alloy comprises less than 0.1 weight percent copper, less than 0.05 weight percent iron, and 7.0 to 9.0 weight percent silicon. In one example of this embodiment, the aluminum alloy comprises 0.8 to 1.2 weight percent magnesium, 0.8 to 1.5 weight percent manganese, less than 1 weight percent zinc, and less than 0.1 weight percent nickel.

In another embodiment of this aspect, the aluminum alloy comprises less than 0.05 weight percent copper, less than 0.03 weight percent iron, and 7.5 to 8.5 weight percent silicon. In one example of this embodiment, the aluminum alloy comprises 0.8 to 1.2 weight percent magnesium, 1.0 to 1.2 weight percent manganese, less than 0.5 weight percent zinc, and less than 0.1 weight percent nickel.

In one embodiment of this aspect, the weight ratio of manganese and iron is at least 35:1. In another embodiment, the weight ratio of manganese and iron is at least 40:1. In yet another embodiment, the combined iron and manganese content is less than 1.55 weight percent. In still another embodiment, the combined iron and manganese content is less than 1.23 weight percent.

In another aspect of the present disclosure, an enhanced aluminum alloy galvanically compatible with a magnesium alloy component is provided. In an embodiment, the alloy consisting essentially of aluminum, less than 0.1 weight percent copper, less than 0.05 weight percent iron, 7.0 to 9.0 weight percent silicon, 0.8 to 1.2 weight percent magnesium, and 0.8 to 1.5 weight percent manganese. The aluminum alloy further consisting essentially of less than 1 weight percent zinc, less than 0.1 weight percent nickel, less than 0.2 weight percent tin, less than 0.05 weight percent titanium, and 0.008 to 0.015 weight percent strontium. In this embodiment, manganese and iron have a weight ratio of at least 30:1. Furthermore, the combined iron and manganese content is less than 1.55 weight percent.

In another embodiment of this aspect, the aluminum alloy consisting essentially of less than 0.05 weight percent copper, less than 0.03 weight percent iron, 7.5 to 8.5 weight percent silicon, 0.8 to 1.2 weight percent magnesium, 1.0 to 1.2 weight percent manganese, and less than 0.5 weight percent zinc. The aluminum alloy further consisting essentially of less than 0.1 weight percent nickel, less than 0.2 weight percent tin, less than 0.05 weight percent titanium, and 0.01 to 0.015 weight percent strontium.

In another embodiment of this aspect, 3% or less of the alloy is liquid at the temperature range between 450 degrees Celsius and 550 degrees Celsius.

In yet another embodiment of this aspect, the aluminum alloy consisting essentially of less than 0.05 weight percent copper, less than 0.03 weight percent iron, and 7.5 to 8.5 weight percent silicon. In an example of this embodiment, the aluminum alloy consisting essentially of 0.8 to 1.2 weight percent magnesium, 1.0 to 1.2 weight percent manganese, less than 0.5 weight percent zinc, and less than 0.1 weight percent nickel.

In another embodiment, the weight ratio of manganese and iron is at least 40:1. In yet another embodiment, the iron and manganese combined content is less than 1.23 weight percent.

In another aspect of the present disclosure, an enhanced aluminum alloy galvanically compatible with a magnesium alloy component is provided. The alloy comprises aluminum, less than 0.05 weight percent copper, less than 0.03 weight percent iron, 7.5 to 8.5 weight percent silicon, 0.8 to 1.2 weight percent magnesium, and 1.0 to 1.2 weight percent manganese. The aluminum alloy further comprises less than 0.5 weight percent zinc, less than 0.1 weight percent nickel, less than 0.2 weight percent tin, less than 0.05 weight percent titanium, and 0.01 to 0.015 weight percent strontium. In this aspect, manganese and iron have a weight ratio of at least 40:1. Moreover, iron and manganese combined content is less than 1.23 weight percent.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses. Embodiments of the present disclosure provide a new and enhanced aluminum alloy that is galvanically compatible with magnesium alloy component. The enhanced aluminum alloy has improved resistance to galvanic corrosion and increased strength. Moreover, the enhanced aluminum alloy has improved castability in terms of freezing range, particularly in the last 10 percent of alloy solidification with low melting point phases (fraction of solidification). Furthermore, the enhanced aluminum alloy has improved mechanical properties than traditional die cast alloys.

Figure 1:
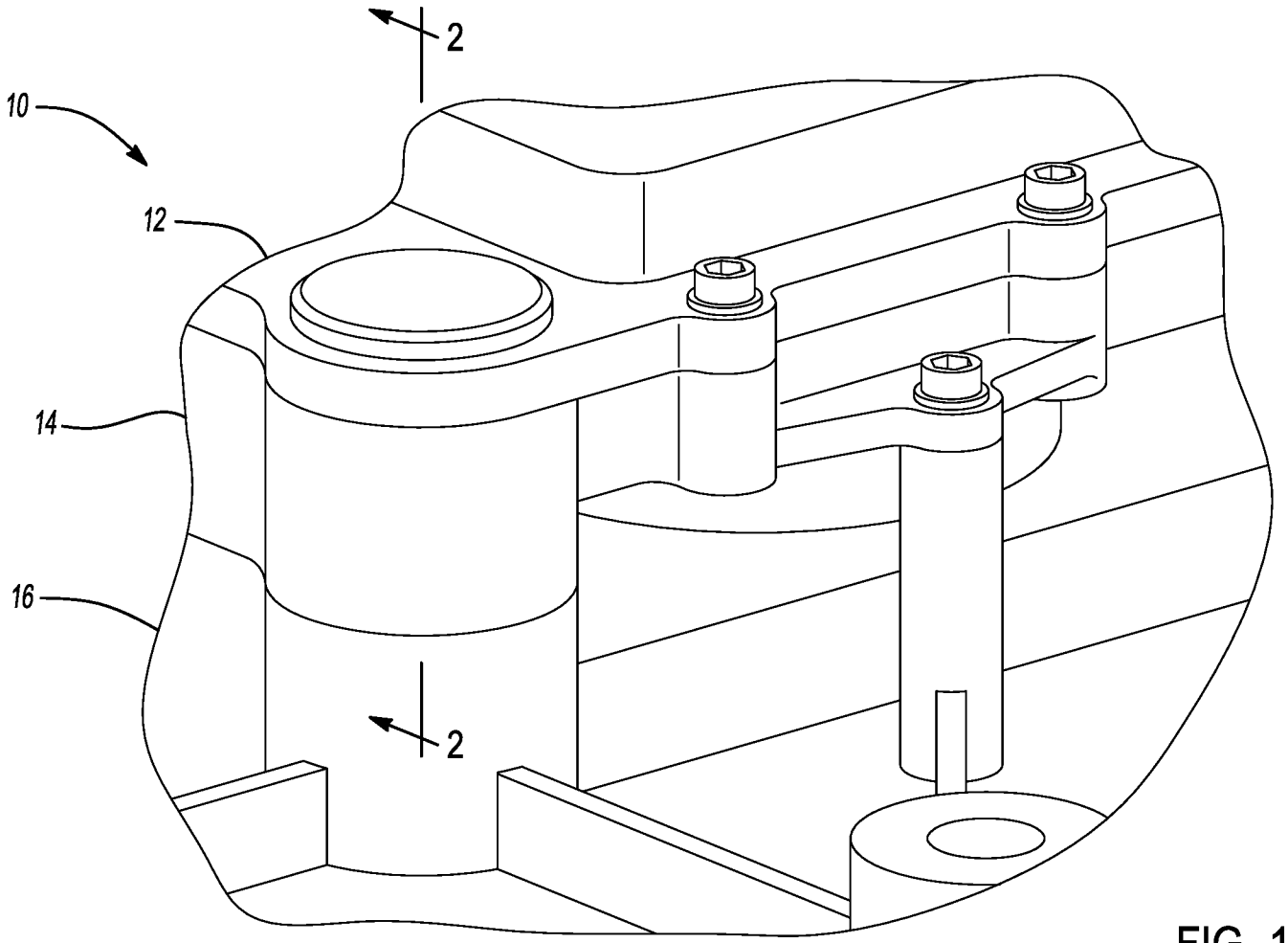
FIG. 1 is an environmental view of an enhanced aluminum alloy galvanically compatible with a magnesium alloy component in accordance with one embodiment of the present disclosure.

FIG. 1 illustrates an automotive assembly 10 that includes an enhanced aluminum alloy component in accordance with one embodiment of the present disclosure. As shown, the automotive assembly 10 is an automotive drive unit comprising a polymeric top 12, an enhanced aluminum alloy component 14 (aluminum alloy housing), and a magnesium alloy component 16 (magnesium alloy drive unit case) in accordance with one embodiment of the present disclosure. The enhanced aluminum alloy component 14 comprises an enhanced aluminum alloy that is galvanically compatible with the magnesium alloy component 16. In this embodiment, the polymeric top 12 is disposed on the enhanced aluminum alloy component 14. Moreover, the aluminum alloy component 14 is disposed on and is in contact with the magnesium alloy component 16. Additionally, the aluminum alloy component 14 is galvanically compatible with the magnesium alloy component 16. That is, the aluminum alloy component 14 has a composition that provides an enhanced resistance to galvanic corrosion while maintaining relatively high strength.

Although FIG. 1 depicts an automotive drive unit casing, it is understood that the automotive assembly may include engine assemblies, transmission cases, units, housing or any other suitable assembly wherein an aluminum alloy and a magnesium alloy are in contact, without departing from the spirit or scope of the present disclosure.

Figure 2:
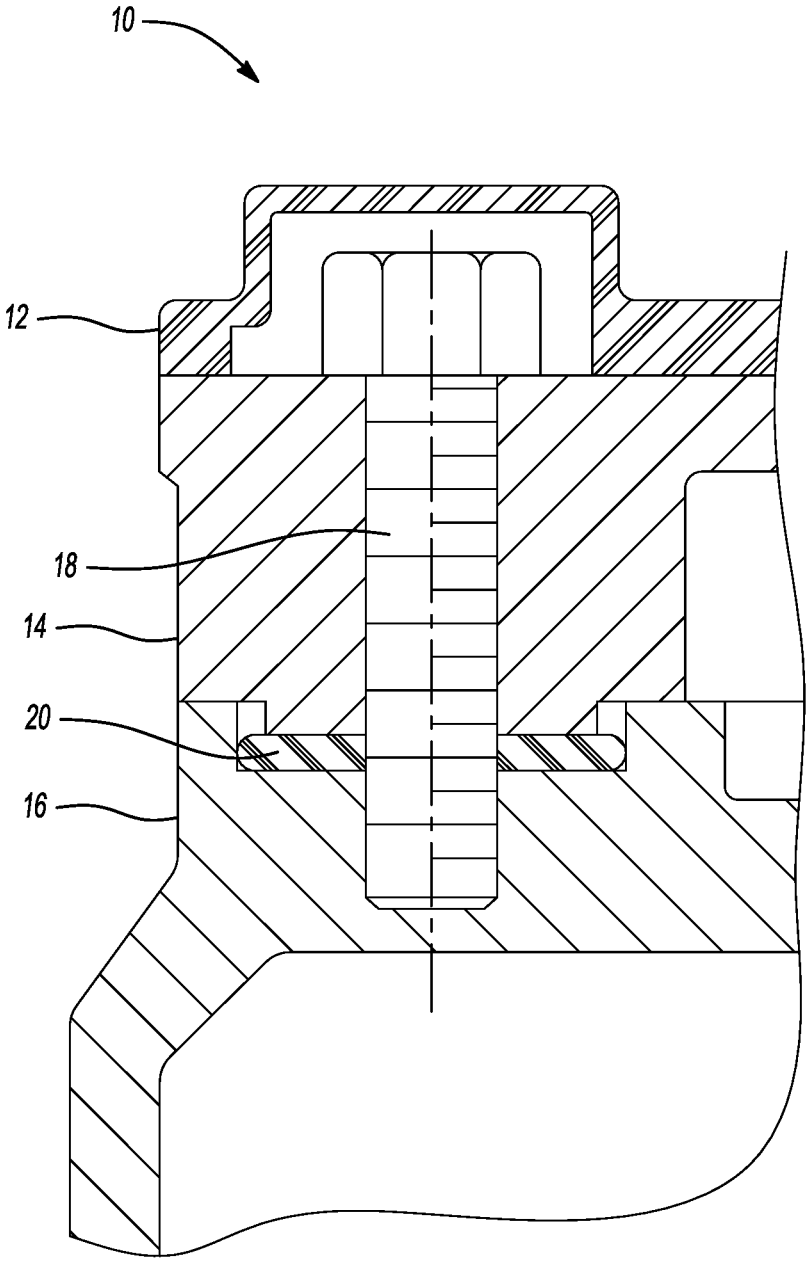
FIG. 2 is a cross-sectional view of the aluminum alloy and the magnesium alloy component in FIG. 1 taken along lines 2-2.

FIG. 2 depicts a cross-section of the assembly 10 of FIG. 1 in accordance with one embodiment of the present disclosure. As shown, a fastener or bolt 18 connects the aluminum alloy component 14 to the magnesium alloy component 16 with a rubber seal 20 disposed therebetween. The polymeric top 12 is disposed on the aluminum component 14 and covers the bolt 18. As it can be seen, direct contact between the aluminum alloy 14 and the magnesium alloy 16 is made about the rubber seal 20 and the bolt 18. The composition of the aluminum alloy component 14 provides an enhanced resistance to galvanic corrosion while maintaining relatively high strength.

Figure 3:
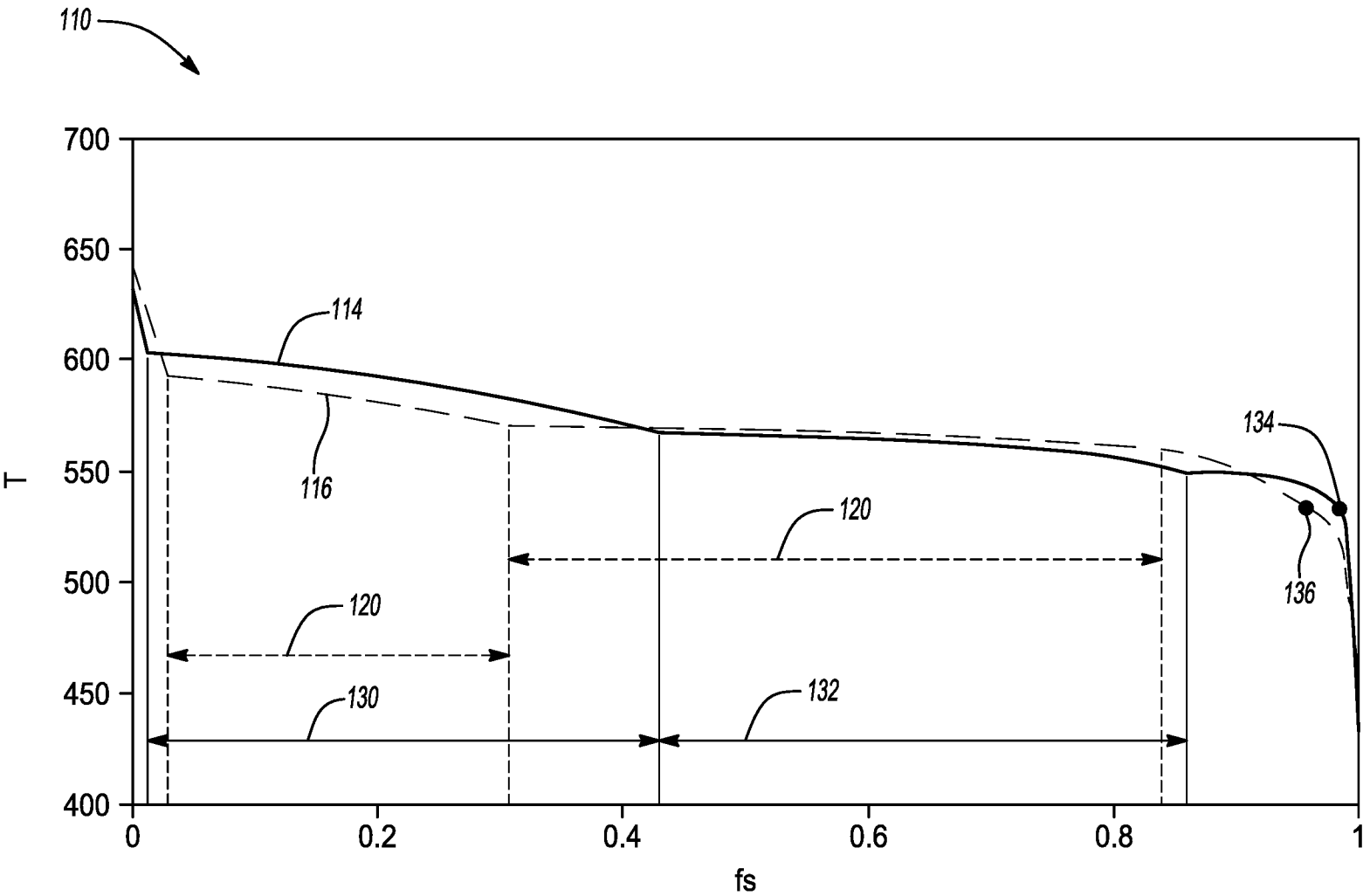
FIG. 3 is a temperature-fraction of solid graph of the enhanced aluminum alloy in accordance with one embodiment of the present disclosure.

FIG. 3 is a temperature-fraction of solid graph 110 showing a solidification relationship between one embodiment of the enhanced aluminum alloy 114 of the aluminum alloy component 14 and a known aluminum alloy (A360) 116. As shown, both alloys 114, 116 are liquid at 650 degrees Celsius. At about 640 degrees Celsius, the enhanced aluminum alloy 114 begins to solidify. Moreover, at about 635 degrees Celsius, the A360 alloy 116 starts to solidify.

As it can be seen in FIG. 3, the enhanced aluminum alloy 114 and the A360 alloy 116 undergo solidification in two-phases (liquid and solid) between about 605 degrees Celsius and about 540 degrees Celsius. Between about 590 degrees Celsius and about 575 degrees Celsius, the A360 alloy 116 solidifies at a first beta Fe-rich intermetallic phase 120. Moreover, between about 575 degrees Celsius and about 540 degrees Celsius, the A360 alloy 116 continuously solidifies at a second beta Fe-rich intermetallic phase 122. During both of the first beta phase 120 and the second beta phase 122, the A360 alloy 116 includes an alpha Fe-rich intermetallic [Al+Al15(FeMn)3Si2] and a beta Fe-rich intermetallic [β(Al5FeSi)]. In particular, the beta Fe-rich intermetallic phase is known to cause increased porosity and brittleness in the alloy. As a result, increased porosity and brittleness negatively impact the strength and ductility of the alloy.

As it also can be seen in FIG. 3, the enhanced aluminum alloy 114 solidifies at a first non-beta Fe-rich intermetallic phase 130 between about 605 degrees Celsius and about 575 degrees Celsius. Moreover, the enhanced aluminum alloy 114 solidifies at a second non-beta Fe-rich intermetallic phase 132 between about 575 degrees Celsius and about 550 degrees Celsius. During both of the first non-beta phase 130 and the second non-beta phase 132, the enhanced aluminum alloy includes only the alpha Fe-rich intermetallic phase and is absent the beta Fe-rich intermetallic phase. As a result, the enhanced aluminum alloy has less porosity and brittleness. Thus, the enhanced aluminum alloy has more strength and ductility than the A360 alloy.

FIG. 3 further shows that the enhanced aluminum alloy 114 has a relatively narrower freeze range than the A360 alloy 116. Moreover, the enhanced aluminum alloy 114 has a lower liquid fraction (higher solidification fraction) at a final non-beta Fe-rich intermetallic phase 134 of solidification at 540 degrees Celsius than the A360 alloy 116 at a final beta Fe-rich intermetallic phase 136 of solidification at 540 degrees Celsius. That is, the enhanced aluminum alloy 114 has less than 3 percent liquid (97 percent solidified) in the final non-beta Fe-rich intermetallic phase 134 of solidification, i.e., at temperatures between about 540 degrees Celsius and about 450 degrees Celsius. On the other hand, the A360 alloy 116 has more than 6 percent liquid (94 percent solidified) in the final beta Fe-rich phase 136 of solidification.

Thus, the enhanced aluminum alloy 114 has a higher fraction of solid (0.97) than the A360 alloy 116 at 540 degrees Celsius, the start of the final non-beta Fe-rich intermetallic phase 134 of solidification. Moreover, the enhanced aluminum alloy 114 has a narrower range of solidification than the A360 alloy 116 at 540 degrees Celsius. A higher fraction of solid between such temperatures in the final beta Fe-rich phase 136 has shown to produce less porosity. Less porosity and less amount of melt in the final stage of solidification decreases the likelihood of hot tearing/hot cracking which weakens or negatively affects the strength of the alloy. Less hot tearing/hot cracking decreases the likelihood of premature fracture of the alloy component.

As such, the known aluminum A360 alloy 116 has a lower fraction of solid (0.94) than the enhanced aluminum alloy 114 at 540 degrees Celsius. Hence, the lower fraction of solid of the A360 alloy 116 at such temperature translates to a greater likelihood of having more porosity which increases the likelihood of hot tearing/hot cracking. In turn, the increase in the likelihood of hot tearing/hot cracking negatively affects the strength of the A360 alloy 116. Hence, the A360 alloy 116 has a higher likelihood of premature fractures. Therefore, FIG. 3 shows that the enhanced aluminum alloy 114 is more resistant to corrosion and has higher strength than the A360 alloy 116.

Exemplary compositions of the enhanced aluminum alloy (in weight percent) are provided below in Tables A and B.

TABLE A

| Alloys | Al | Cu | Fe | Si | Mg | Mn |
|---|---|---|---|---|---|---|
| Alloy 1 | Bal. | <0.2 | <0.2 | 6.0-9.0 | 0.6-1.5 | >0.8 |
| Alloy 2 | Bal. | <0.1 | <0.05 | 7.0-9.0 | 0.8-1.2 | 0.8-1.5 |
| Alloy 3 | Bal. | <0.05 | <0.03 | 7.5-8.5 | 1.0-1.2 | 0.9-1.2 |

TABLE B

| Alloys | Zn | Ni | Sn | Ti | Sr |
|---|---|---|---|---|---|
| Alloy 1 | <2 | <0.1 | <0.2 | <0.05 | 0.008-0.02 |
| Alloy 2 | <1 | <0.1 | <0.2 | <0.05 | 0.008-0.015 |
| Alloy 3 | <0.5 | <0.1 | <0.2 | <0.05 | 0.01-0.015 |

Referring to Tables A and B, an enhanced aluminum alloy termed "Alloy 1" comprises aluminum, less than 0.2 weight percent (wt. %) copper (Cu), less than 0.2 weight percent iron (Fe), 6.0 to 9.0 weight percent silicon (Si), 0.6 to 1.5 weight percent magnesium (Mg), and greater than 0.8 weight percent manganese (Mn). Moreover, the aluminum alloy further comprises less than 2 weight percent zinc (Zn), less than 0.1 weight percent nickel (Ni), less than 0.2 weight percent tin (Sn), less than 0.05 weight percent titanium (Ti), and 0.008 to 0.02 weight percent strontium (Sr). In this example, manganese and iron have a weight ratio of at least 30:1. Furthermore, the iron-manganese combined content is less than 2.0 weight percent.

In this embodiment, Alloy 1 may include elements that vary in weight percent. For example, Alloy 1 may preferably comprise less than 0.1 weight percent copper and more preferably less than 0.05 weight percent copper. Alloy 1 may preferably comprise less than 0.05 weight percent iron and more preferably less than 0.03 weight percent iron. Moreover, Alloy 1 may preferably comprise 7.0 to 9.0 weight percent silicon and more preferably 7.5 to 8.5 weight percent silicon. Moreover, Alloy 1 may preferably comprise 0.8 to 1.2 weight percent magnesium and more preferably 1.0 to 1.2 weight percent magnesium. Further, Alloy 1 may preferably comprise 0.8 to 1.5 weight percent manganese and more preferably 0.9 to 1.2 weight percent manganese. Additionally, Alloy 1 may preferably comprise less than 1 weight percent zinc and more preferably less than 0.5 weight percent zinc. Furthermore, Alloy 1 may preferably comprise 0.008 to 0.015 weight percent strontium. In this example, manganese and iron maintains a weight ratio of at least 30:1, and the iron-manganese combined content remains at less than 2.0 weight percent.

In other examples of Alloy 1, the weight ratio of manganese and iron may preferably be at least 35:1 and more preferably be at least 40:1. Moreover, the iron-manganese combined content may preferably be less than 1.55 weight percent and more preferably be less than 1.23 weight percent.

In the "Alloy 1" example, 3% or less of the aluminum alloy may be liquid at temperatures between 450 degrees Celsius and 550 degrees Celsius.

Referring to Tables A and B, an enhanced aluminum alloy termed "Alloy 2" comprises aluminum, less than 0.1 weight percent copper, less than 0.05 weight percent iron, 7.0 to 9.0 weight percent silicon, 0.8 to 1.2 weight percent magnesium, and 0.8 to 1.5 weight percent manganese. In this example, Alloy 2 further comprises less than 1 weight percent zinc, less than 0.1 weight percent nickel, less than 0.2 weight percent tin, less than 0.05 weight percent titanium, and 0.008 to 0.015 weight percent strontium. In this example, manganese and iron have a weight ratio of at least 30:1. Furthermore, iron and manganese combined content is less than 1.55 weight percent.

In this embodiment, Alloy 2 may include elements that vary in weight percent. For example, Alloy 2 may more preferably comprise less than 0.05 weight percent copper. Moreover, Alloy 2 may more preferably comprise less than 0.03 weight percent iron, 7.5 to 8.5 weight percent silicon, and 0.8 to 1.2 weight percent magnesium. Further, Alloy 2 may more preferably comprise 1.0 to 1.2 weight percent manganese and less than 0.5 weight percent zinc. Additionally, Alloy 2 may more preferably comprise less than 0.1 weight percent nickel, less than 0.2 weight percent tin, less than 0.05 weight percent titanium, and 0.01 to 0.015 weight percent strontium.

In these examples of Alloy 2, 3% or less of the alloy is liquid at temperature between 450 degrees Celsius and 550 degrees Celsius. In other embodiments of Alloy 2, the weight ratio of manganese and iron is more preferably at least 40:1, and the iron-manganese combined content is more preferably less than 1.23 weight percent.

Referring to Tables A and B, an enhanced aluminum alloy termed "Alloy 3" comprises aluminum, less than 0.05 weight percent copper, less than 0.03 weight percent iron, 7.5 to 8.5 weight percent silicon, 0.8 to 1.2 weight percent magnesium, and 1.0 to 1.2 weight percent manganese. The aluminum alloy further comprises less than 0.5 weight percent zinc, less than 0.1 weight percent nickel, less than 0.2 weight percent tin, less than 0.05 weight percent titanium, and 0.01 to 0.015 weight percent strontium. In this aspect, manganese and iron have a weight ratio of at least 40:1. Moreover, iron and manganese combined content is less than 1.23 weight percent.

A method of making an enhanced aluminum alloy galvanically compatible with a magnesium alloy component is disclosed. The method comprises selecting a starting alloy having relatively close composition as the enhanced aluminum alloy of the present disclosure. That is, commercially available aluminum alloys may be selected. Such commercially available aluminum alloys may include but are not limited to the following known alloys: A356, B356, C356, F356, 357, A357, B357, C357, and 359. The commercially available alloy should be an alloy with iron and copper content less than 0.2 weight percent.

For example, iron and copper element content may be used as a basis for selecting the commercially available aluminum alloy. As a further example, commercially available A356 alloy may be selected to meet an iron level of less than 0.2 weight percent and a copper level of less than 0.2 weight percent. In this example, the A356 alloy has a composition of 7 weight percent silicon, 0.4 weight percent magnesium, less than 0.2 weight percent iron, less than 0.2 weight percent copper, less than 0.1 weight percent manganese, 0.2 weight percent titanium, less than 0.05 weight percent of other elements.

The method further comprises adjusting content of the starting alloy by adding master alloys (e.g., Al—Si, Al—Mg, Al—Mn) to the starting alloy (liquid phase) to meet a specification of the enhanced aluminum alloy of the present disclosure. For example, the specification of the enhanced aluminum alloy may be Alloy 1 discussed above and shown in Tables A and B. Thus, in this example, the step of adjusting content of the starting alloy includes adding master alloys accordingly to the starting alloy to achieve the composition of Alloy 1.

It is understood that there may be a number of ways to achieve a nominal composition of the enhanced aluminum alloy of the present disclosure. The nominal composition may be defined as the magnitude or ranges of magnitudes of each element in the examples of the enhanced aluminum alloy discussed herein and in Tables A and B.

As a further example, to achieve a nominal composition of the elements for the enhanced aluminum alloy (e.g., 8 wt % Si, 1.1 wt % Mg, 1.05 wt % Mn), the following master alloys may be used: Aluminum (Al) with 50 wt % Si (Al-50 wt % Si), Al with 50 wt % Mg (Al-50 wt % Mg) and Al with 20 wt % Mn (Al-20 wt % Mn).

A formula may be used to add master alloys to adjust the content of the starting alloy, thereby achieving a nominal composition of the enhanced aluminum alloy of the present disclosure. For example, X*(1/0.5)*(8−7)%/Recovery_Si of Al-50 wt % Si master alloy, X*(1/0.5)*(1.1−0.4)%/Recovery_Mg of Al-50 wt % Mg master alloy, and X*(1/0.2)*(1.05−0.05)%/Recovery_Mn of Al-20 wt % Mn master alloy are added to the A356, respectively. In this example, X may be defined as the amount of A356 liquid melt. Recovery_Si is the recovery rate of Si (i.e. 97%). Recovery_Mg is the recovery rate of Mg (i.e. ~92%). Recovery_Mn is the recovery rate of Mn (i.e. 98%).

After master alloys are added, the method further comprises stirring the master alloy(s) and starting alloy (liquid phase) for at least 5 minutes, preferably 5 to 15 minutes, and more preferably 10 minutes, defining a metal slurry or melt. The step of stirring helps confirm that any master alloys in solid phase is melted and mixed with the starting alloy.

A sample may be taken from the metal slurry or melt to verify that the alloy composition meets a desired composition of the enhanced aluminum alloy discussed above. Upon verification, the melt may be further treated with fluxes (i.e. F-containing or non F-containing fluxes) to remove oxides and inclusion in the liquid metal. The method further comprises pouring the slurry or melt into ingots and other forms as desired.

As a result, the enhanced aluminum alloy provides improved properties. For example, the enhanced aluminum alloy (as-cast) may have a tensile strength of 280 to 310 MPa, a yield strength of 160 to 185 MPa, an elongation of greater than 3.5%, a thermal conductivity of greater than 116 W/mK at 77 degrees Fahrenheit, a density of about 2.63 gms cm-3, and a corrosion resistance of 10 out of 10 under a potentiodynamic polarization test wherein 10 is the highest corrosion resistance level.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An aluminum alloy galvanically compatible with a magnesium alloy component, the alloy comprising:
aluminum;
less than 0.2 weight percent copper;
less than 0.2 weight percent iron;
6.0 to 9.0 weight percent silicon;
1.0 to 1.5 weight percent magnesium;
greater than 0.8 weight percent manganese;
less than 2 weight percent zinc;
less than 0.1 weight percent nickel;
less than 0.2 weight percent tin;
less than 0.05 weight percent titanium; and
0.008 to 0.02 weight percent strontium,
wherein manganese and iron have a weight ratio of at least 30:1 and wherein iron and manganese combined content is less than 2.0 weight percent.

2. The aluminum alloy of claim 1 wherein the aluminum alloy comprises:
less than 0.1 weight percent copper;
less than 0.05 weight percent iron;
7.0 to 9.0 weight percent silicon;
0.8 to 1.2 weight percent magnesium;
0.9 to 1.5 weight percent manganese;
less than 1 weight percent zinc;
less than 0.1 weight percent nickel;
less than 0.2 weight percent tin;
less than 0.05 weight percent titanium; and
0.008 to 0.015 weight percent strontium.

3. The aluminum alloy of claim 1 wherein the aluminum alloy comprises:
less than 0.05 weight percent copper;
less than 0.03 weight percent iron;
7.5 to 8.5 weight percent silicon;
0.8 to 1.2 weight percent magnesium;
1.0 to 1.2 weight percent manganese;
less than 0.5 weight percent zinc;
less than 0.1 weight percent nickel;
less than 0.2 weight percent tin;
less than 0.05 weight percent titanium; and
0.01 to 0.015 weight percent strontium.

4. The aluminum alloy of claim 1 wherein 3% or less of the alloy is liquid at temperature between 450 degrees Celsius and 550 degrees Celsius.

5. The aluminum alloy of claim 1 wherein the aluminum alloy comprises:
less than 0.1 weight percent copper;
less than 0.05 weight percent iron; and
7.0 to 9.0 weight percent silicon.

6. The aluminum alloy of claim 5 wherein the aluminum alloy comprises:
0.8 to 1.2 weight percent magnesium;
0.9 to 1.5 weight percent manganese;
less than 1 weight percent zinc; and
less than 0.1 weight percent nickel.

7. The aluminum alloy of claim 1 wherein the aluminum alloy comprises:
less than 0.05 weight percent copper;
less than 0.03 weight percent iron; and
7.5 to 8.5 weight percent silicon.

8. The aluminum alloy of claim 7 wherein the aluminum alloy comprises:
0.8 to 1.2 weight percent magnesium;
1.0 to 1.2 weight percent manganese;
less than 0.5 weight percent zinc; and
less than 0.1 weight percent nickel.

9. The aluminum alloy of claim 1 wherein the weight ratio of manganese and iron is at least 35:1.

10. The aluminum alloy of claim 1 wherein the weight ratio of manganese and iron is at least 40:1.

11. The aluminum alloy of claim 1 wherein the iron and manganese combined content is less than 1.55 weight percent.

12. The aluminum alloy of claim 1 wherein the iron and manganese combined content is less than 1.23 weight percent.

13. An aluminum alloy galvanically compatible with a magnesium alloy component, the alloy consisting essentially of:

aluminum;
less than 0.1 weight percent copper;
less than 0.05 weight percent iron;
7.0 to 9.0 weight percent silicon;
1.0 to 1.5 weight percent magnesium;
0.8 to 1.5 weight percent manganese;
less than 1 weight percent zinc;
less than 0.1 weight percent nickel;
less than 0.2 weight percent tin;
less than 0.05 weight percent titanium; and
0.008 to 0.015 weight percent strontium,
wherein manganese and iron have a weight ratio of at least 30:1 and wherein iron and manganese combined content is less than 1.55 weight percent, and
wherein the aluminum alloy includes only alpha Fe-rich intermetallic and is absent beta Fe-rich intermetallic at between about 605 degrees Celsius and about 575 degrees Celsius.

14. The aluminum alloy of claim 13 wherein the aluminum alloy consisting essentially of:

less than 0.05 weight percent copper;
less than 0.03 weight percent iron;
7.5 to 8.5 weight percent silicon;
0.8 to 1.2 weight percent magnesium;
1.0 to 1.2 weight percent manganese;
less than 0.5 weight percent zinc;
less than 0.1 weight percent nickel;
less than 0.2 weight percent tin;
less than 0.05 weight percent titanium; and
0.01 to 0.015 weight percent strontium.

15. The aluminum alloy of claim 13 wherein 3% or less of the alloy is liquid at temperatures between 450 degrees Celsius and 550 degrees Celsius.

16. The aluminum alloy of claim 13 wherein the aluminum alloy consisting essentially of:

less than 0.05 weight percent copper;
less than 0.03 weight percent iron; and
7.5 to 8.5 weight percent silicon.

17. The aluminum alloy of claim 16 wherein the aluminum alloy consisting essentially of:

0.8 to 1.2 weight percent magnesium;
1.0 to 1.2 weight percent manganese;
less than 0.5 weight percent zinc; and
less than 0.1 weight percent nickel.

18. The aluminum alloy of claim 13 wherein the weight ratio of manganese and iron is at least 40:1.

19. The aluminum alloy of claim 13 wherein the iron and manganese combined content is less than 1.23 weight percent.

20. An aluminum alloy galvanically compatible with a magnesium alloy component, the alloy comprising:

aluminum;
less than 0.05 weight percent copper;
less than 0.03 weight percent iron;
7.5 to 8.5 weight percent silicon;
1.0 to 1.5 weight percent magnesium;
1.0 to 1.2 weight percent manganese;
less than 0.5 weight percent zinc;
less than 0.1 weight percent nickel;
less than 0.2 weight percent tin;
less than 0.05 weight percent titanium; and
0.01 to 0.015 weight percent strontium,
wherein manganese and iron have a weight ratio of at least 40:1 and wherein iron and manganese combined content is less than 1.23 weight percent, and
wherein the aluminum alloy includes only alpha Fe-rich intermetallic and is absent beta Fe-rich intermetallic at between about 605 degrees Celsius and about 575 degrees Celsius.

* * * * *